US011458493B2

(12) United States Patent
Zandonà

(10) Patent No.: US 11,458,493 B2
(45) Date of Patent: Oct. 4, 2022

(54) DEVICE FOR DISPENSING FLUIDS OR LIQUIDS IN GENERAL AND SYSTEM USING THIS DEVICE

(71) Applicant: TAPLAST s.r.l., Vicenza (IT)

(72) Inventor: Raffaele Zandonà, San Pietro (IT)

(73) Assignee: TAPLAST s.r.l.

( * ) Notice: Subject to any disclaimer, the term of this patent is extended or adjusted under 35 U.S.C. 154(b) by 0 days.

(21) Appl. No.: 17/274,219

(22) PCT Filed: Aug. 6, 2019

(86) PCT No.: PCT/IB2019/056677

§ 371 (c)(1),
(2) Date: Mar. 8, 2021

(87) PCT Pub. No.: WO2020/049380

PCT Pub. Date: Mar. 12, 2020

(65) Prior Publication Data

US 2021/0308707 A1 Oct. 7, 2021

(30) Foreign Application Priority Data

Sep. 6, 2018 (IT) ..... 102018000008383

(51) Int. Cl.
*B05B 11/00* (2006.01)

(52) U.S. Cl.
CPC ..... *B05B 11/3011* (2013.01); *B05B 11/0094* (2013.01)

(58) Field of Classification Search
CPC . B05B 11/3011; B05B 11/0094; B05B 11/04; B05B 11/0091; B05B 11/3001; B05B 11/3074
See application file for complete search history.

(56) References Cited

U.S. PATENT DOCUMENTS

| | | | |
|---|---|---|---|
| 3,181,743 | A | 5/1965 | Libit et al. |
| 5,501,375 | A | 3/1996 | Nilson |
| 5,549,226 | A | 8/1996 | Kopp |

FOREIGN PATENT DOCUMENTS

| | | | |
|---|---|---|---|
| DE | 10255579 | A1 | 6/2004 |
| JP | S624082 | A | 1/1987 |

OTHER PUBLICATIONS

JP 624082 with Machine Translation (Year: 1987).*
Search Report and Written Opinion dated Oct. 10, 2019; International Patent Application No. PCT/IB2019/056677, filed Aug. 6, 2019. ISA/EP.

* cited by examiner

*Primary Examiner* — Vishal Pancholi
(74) *Attorney, Agent, or Firm* — McDonald Hopkins LLC

(57) ABSTRACT

The present invention concerns a dispensing device suited to dispense a fluid or liquid held in a container. The device comprises drawing means suited to draw the fluid or liquid from the container and a dispensing duct for dispensing the fluid or liquid. The dispensing duct is defined by a tubular element comprising at least one flexible portion.

14 Claims, 13 Drawing Sheets

DEVICE FOR DISPENSING FLUIDS OR LIQUIDS IN GENERAL AND SYSTEM USING THIS DEVICE

CROSS-REFERENCE TO RELATED APPLICATION

This application is a 35 U.S.C. 371 national stage filing of PCT Application No. PCT/I132019/056677 filed Aug. 6, 2019, entitled "DEVICE FOR DISPENSING FLUIDS OR. LIQUIDS IN GENERAL AND SYSTEM USING THIS DEVICE," which claims priority to Italian Patent Application No. 102018000008383 filed on Sep. 6, 2018, each of which are incorporated herein in their entirety by reference.

TECHNICAL FIELD OF THE INVENTION

The present invention concerns the dispensing of fluids or liquids. More specifically, the present invention concerns the dispensing of fluids or liquids such as, for example, detergents, soaps, creams, for example for personal hygiene, for hand washing, etc. In greater detail, the present invention concerns a dispensing device for dispensing fluids or liquids of the type described above. In even greater detail, the present invention concerns a dispensing device of the type suited to be coupled with the container holding the fluid or liquid to be dispensed, for example suited to be fixed to the neck of a container in the shape of a bottle or in a similar shape.

DESCRIPTION OF THE STATE OF THE ART

Dispensing devices for dispensing fluids or liquids are known in the art and widely sold and used, said devices being suited to dispense, for example, fluid or liquid soaps for personal care, and to allow fluids or liquids held in a container to be dispensed. Said devices generally comprise engagement means (for example, a threaded ring) designed to allow them to be applied or fixed to a container (for example, to the neck of a bottle-shaped container) and drawing and dispensing means designed to draw the fluid or liquid from the container and successively dispense it towards the outside. The fluid or liquid, then, is actually dispensed through a nozzle or spout.

The drawing means preferably comprise a drawing pipe at least partially immersed in the fluid or liquid to be dispensed, while the dispensing spout is positioned outside the container itself. Pressing the drawing means, for example pushing them vertically downwards with the palm of a hand, makes the fluid or liquid flow upwards through the drawing pipe, conveying and dispensing the fluid or liquid towards the outside through the dispensing spout.

According to the known art, the dispensing spout is preferably oriented horizontally and in such a way that it projects outwards, so that, for example, a hand can be positioned under its free end to collect the dispensed fluid or liquid (in particular, in the typical use with liquid soaps).

Generally, however, the dispensing spout is provided with a portion that projects from the operating area and/or the container, in such a way as to make it easier to dispense the fluid or liquid and convey it according to a predetermined direction.

According to a solution proposed in the known art, which facilitates the construction, assembly, transport and successive use of the dispensing systems described above, the projecting end portion of the dispensing spout is made in two parts hinged to each other, which allow the end portion of the spout to be folded, typically downwards.

In the folded position, the passage for the fluid or liquid inside the spout is conveniently interrupted.

The patent document WO2018104821A1, for example, describes a solution of this type, in which, in the folded position, a suitable shaped part of the end portion of the spout serves to obstruct the passage for the fluid or liquid exactly at the level of the hinge area.

The device carried out in this way makes it possible to fill the container with the fluid or liquid in question and to fold the end portion of the spout, in order to obstruct the outlet way and at the same time reduce the overall dimensions of the spout before it is packaged and transported to the reseller or buyer. Starting from the folded position with obstructed passage, the buyer/user will just need to lift the end portion of the spout to bring it to the substantially horizontal configuration of use.

However, the dispensing devices with folding nozzle/spout of the known type pose some drawbacks.

A first drawback of the devices of the known type is represented by the fact that the spout is not perfectly tight at the level of the hinge area. In this area, in fact, both in the folded position and in the dispensing configuration, fluid or liquid leakages may occur.

This can be caused, for example, by the small plays that may exist between the hinges, for example due to defects generated during the moulding process, which may deteriorate even further over time and with use.

Another drawback posed by said devices is represented by the risk that the two parts that make up the nozzle are separated from each other, causing the fluid or liquid to leak out.

A further drawback of said devices is represented by the risk that the two parts may not be correctly aligned in the dispensing position, with the consequent risk of leakages and/or reduction in the flow of the dispensed fluid or liquid.

Thus, it is one object of the present invention to overcome the drawbacks mentioned above and observed in the solutions known in the art.

More specifically, the purposes and objects of the present invention can be summed up as follows.

It is a first object of the present invention to provide a dispensing device for fluids or liquids that makes it possible to avoid fluid or liquid leakages, independently of its operating configuration.

It is another object of the present invention to provide a dispensing device for fluids or liquids which is more reliable than the devices of the known type over time.

SUMMARY OF THE PRESENT INVENTION

The present invention is based on and originates from the general consideration according to which the drawbacks observed in the devices according to the known art can be overcome or at least minimized by conveniently shaping the dispensing duct, which can be obtained using a tubular element comprising at least one flexible portion.

According to a first aspect of the present invention, therefore, the subject of the same is a dispensing device for a fluid or liquid held in a container, said device comprising drawing means for drawing said fluid or liquid from said container and a dispensing duct for said fluid or liquid, wherein said dispensing duct is defined by a tubular element having a first portion fluidically connected to said drawing means and a second portion provided with an outlet opening for said fluid or liquid, wherein said tubular element comprises at least one flexible portion suited to allow said second portion to be arranged in a first position and in a second position, different from said first position, with respect to said first portion.

According to a preferred embodiment, the first position and/or the second position is/are suited to allow the passage of the fluid or liquid in the dispensing duct.

In a preferred embodiment, in said second position said flexible portion obstructs said dispensing duct completely.

Preferably, the flexible portion of the tubular element comprises a section of the tubular element with reduced thickness.

In a preferred embodiment, the flexible portion comprises an elastically yielding material.

According to a preferred embodiment, the flexible portion comprises a bellows.

Preferably, the device comprises holding means suited to hold the tubular element in the second position.

In a preferred embodiment, the holding means comprise mechanical interference means arranged between the tubular element and the drawing means.

According to a preferred embodiment, the holding means comprise snap-on holding means arranged between the tubular element and the drawing means.

Preferably, the drawing means comprise connection means suited to ensure the mutual connection between the device and the container.

Furthermore, the subject of the present invention includes also a system for dispensing a fluid or liquid, said system comprising a container suited to hold said fluid or liquid and a dispensing device according to one or more of the variant embodiments summed up above and/or described below.

BRIEF DESCRIPTION OF THE DRAWINGS

Further advantages, objects and characteristics, as well as further embodiments of the present invention, are defined in the claims and will be illustrated in the following description, with reference to the enclosed drawings; in the drawings, corresponding or equivalent characteristics and/or components of the present invention are identified by the same reference numbers. In particular, in the drawings:

DETAILED DESCRIPTION OF THE PRESENT INVENTION

Figure 2:
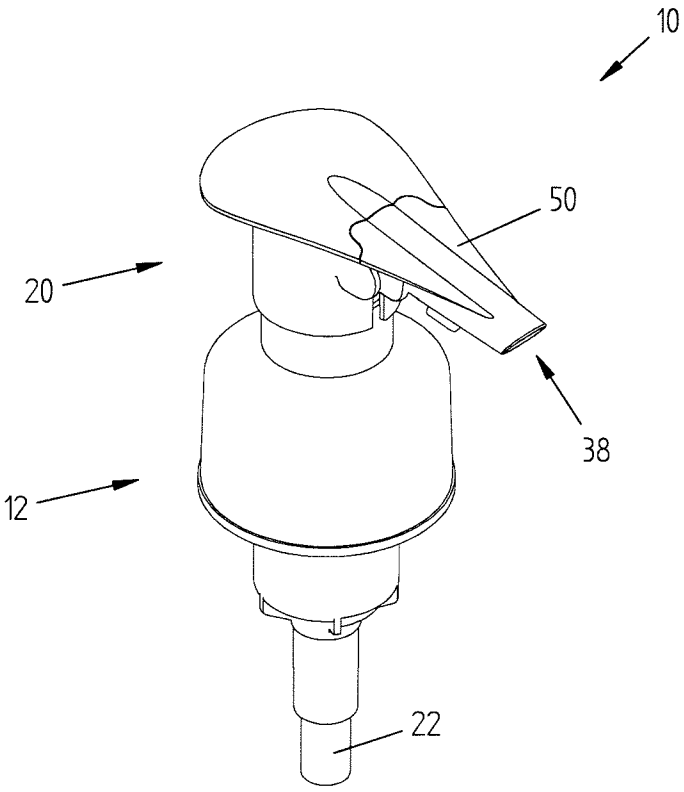
FIG. 2 shows the dispensing device illustrated in FIG. 1 isolated from the container.

Although the present invention is described below with reference to its embodiments illustrated in the drawings, the present invention is not limited to the embodiments illustrated in the drawings and described in detail below. On the contrary, all those variants of the embodiments illustrated in the drawings and described in detail below that are obvious for the expert in the art fall within the scope of the present invention.

The examples of embodiment of the invention described below refer to devices for dispensing products constituted, for example, by a detergent or a liquid soap.

The solution that is the subject of the invention, however, can also refer to devices for dispensing fluids or liquids of any type, for example food products to be taken from a container and conveyed towards the outside.

Figure 1:
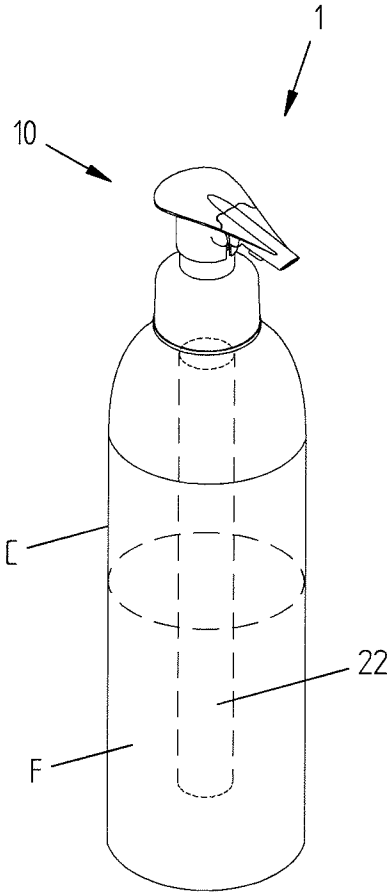
FIG. 1 shows an axonometric view of a dispensing system comprising a dispensing device according to a preferred embodiment of the present invention with the dispensing duct in a first operating position.

An example of embodiment of a device 10 for dispensing fluids or liquids, which is the subject of the present invention, is shown in the dispensing system 1 of FIG. 1, where the dispensing device 10 is applied to a container C holding a fluid or liquid F to be dispensed.

For the sake of simplicity, here below reference will be made to a fluid only, it being understood that it can also be a liquid.

In FIG. 2 the device 10 is represented separate from the container C.

Only in FIG. 1 the dispensing device 10 is shown as a part of a dispensing system 1 according to a first preferred embodiment of the invention.

In the other figures and for the other preferred embodiments described below, the dispensing device according to the invention is represented as a separate part, it being clear that it must be understood as applicable to a container C. Regarding the container C, it can be of any type, for example rigid or collapsible, in plastic or metal and/or in any shape suitable for the intended purpose.

The device 10 preferably comprises drawing means 20 designed to draw the fluid F from the container C through a drawing pipe and a dispensing duct 30 (better visible in FIG. 6) designed to dispense the fluid F withdrawn from the container C.

In the first preferred embodiment illustrated with reference to Figures from 1 to 11, the drawing means 20 allow the fluid F to be dispensed by pressing the device 10 downwards. In the first step, during which the device 10 is pressed, the fluid F is dispensed through the dispensing duct 30 and in the successive release step the device 10 returns to its initial position, as shown in Figures from 1 to 4, ready for the successive dispensing operation.

Figure 6:
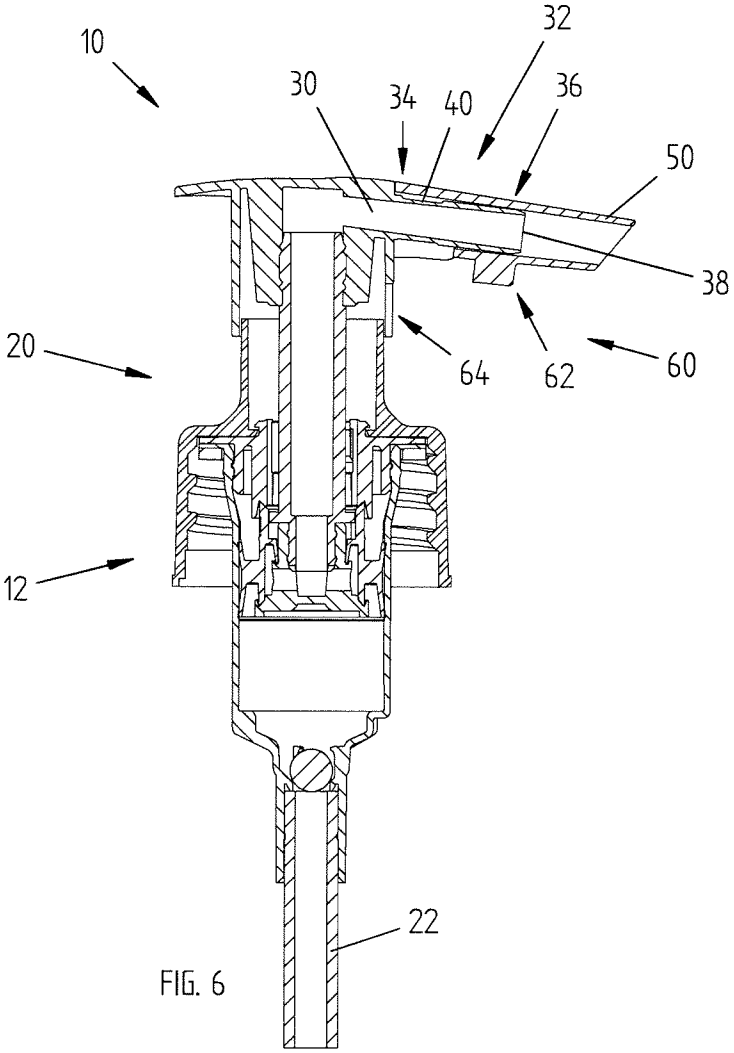
FIG. 6 shows the sectional view of the device illustrated in FIG. 5 according to section line VI-VI.
Figure 5:
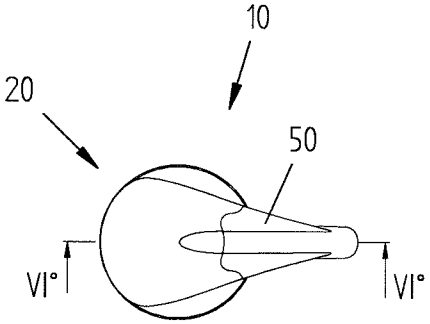
FIG. 5 shows a top plan view of the dispensing device illustrated in FIG. 4.
Figure 4:
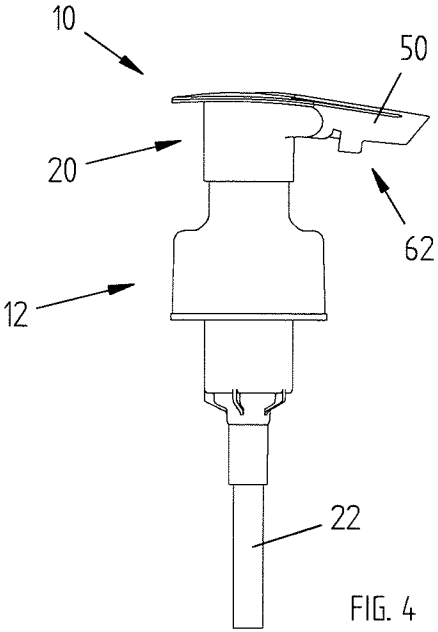
FIG. 4 shows a side plan view of the dispensing device illustrated in FIG. 2.

The construction details of the drawing means 20, visible in particular in the sectional view of FIG. 6, are known per se and are not described in detail here below.

Furthermore, it should be observed that the drawing means can also be made in a manner different from that illustrated herein, according to the type of operation of the dispensing system. Some different drawing means are shown, for example, with reference to the variant embodiments described here below.

In the first preferred embodiment illustrated in Figures from 1 to 11, the drawing means 20 preferably comprise connection means 12, for example a threaded ring, through which the device 10 can be connected/fixed to the container C, preferably screwed to the neck of the container C of the fluid F to be dispensed.

In preferred variant embodiments, however, the connection means may not be present and the dispensing device may preferably be made in a single piece with the container, preferably in a co-moulded plastic material, or connected in such a way that it becomes integral with it, preferably through a welding operation.

According to an aspect of the present invention, the dispensing duct 30 is defined by a tubular element 32 having a first part 34 fluidically connected to the drawing means 20 and a second part 36 provided with an outlet opening 38 for the fluid F.

According to another aspect of the present invention, the tubular element 32 comprises at least one flexible portion 40 suited to allow the second part 36 to be arranged in a first position and in a second position, different from the first position, with respect to the first part 34.

Figures from 1 to 6 show the device 10 with the tubular element 32 arranged in said first position, preferably corresponding to the dispensing position.

Figures from 7 to 11, instead, show the device 10 with the tubular element 32 arranged in said second position, preferably corresponding to the rest position or packaging position of the device 10.

For example, the second position corresponds to the position in which the device 10 is positioned during the packaging step, once the container C has been filled with fluid F and prepared to be transported towards the buyer.

In the first preferred embodiment illustrated and described with reference to Figures from 1 to 11, in the second position the flexible portion 40 obstructs the dispensing duct 30 completely, as can be seen in the detail shown in FIG. 11.

In said second position, therefore, the outflow of the fluid F from the dispensing duct 30 is prevented in a safe manner. Compared to the known systems, in particular, the dispensing duct 30 features better water tightness at the level of the obstruction area, since there are no mechanical elements that interrupt the tubular element 32, such as hinges, for example.

In the embodiment illustrated and described with reference to Figures from 1 to 11, the tubular element 32 is preferably made in a single piece with the drawing means 20, more preferably by co-moulding a plastic material.

In variant embodiments, however, the tubular element may be made as a separate element, as can be seen for example in the embodiments shown in Figures from 29 to 45, and be successively associated with the drawing means, for example through a glueing or heat welding or ultrasound welding process or through mechanical interference.

Figure 3:
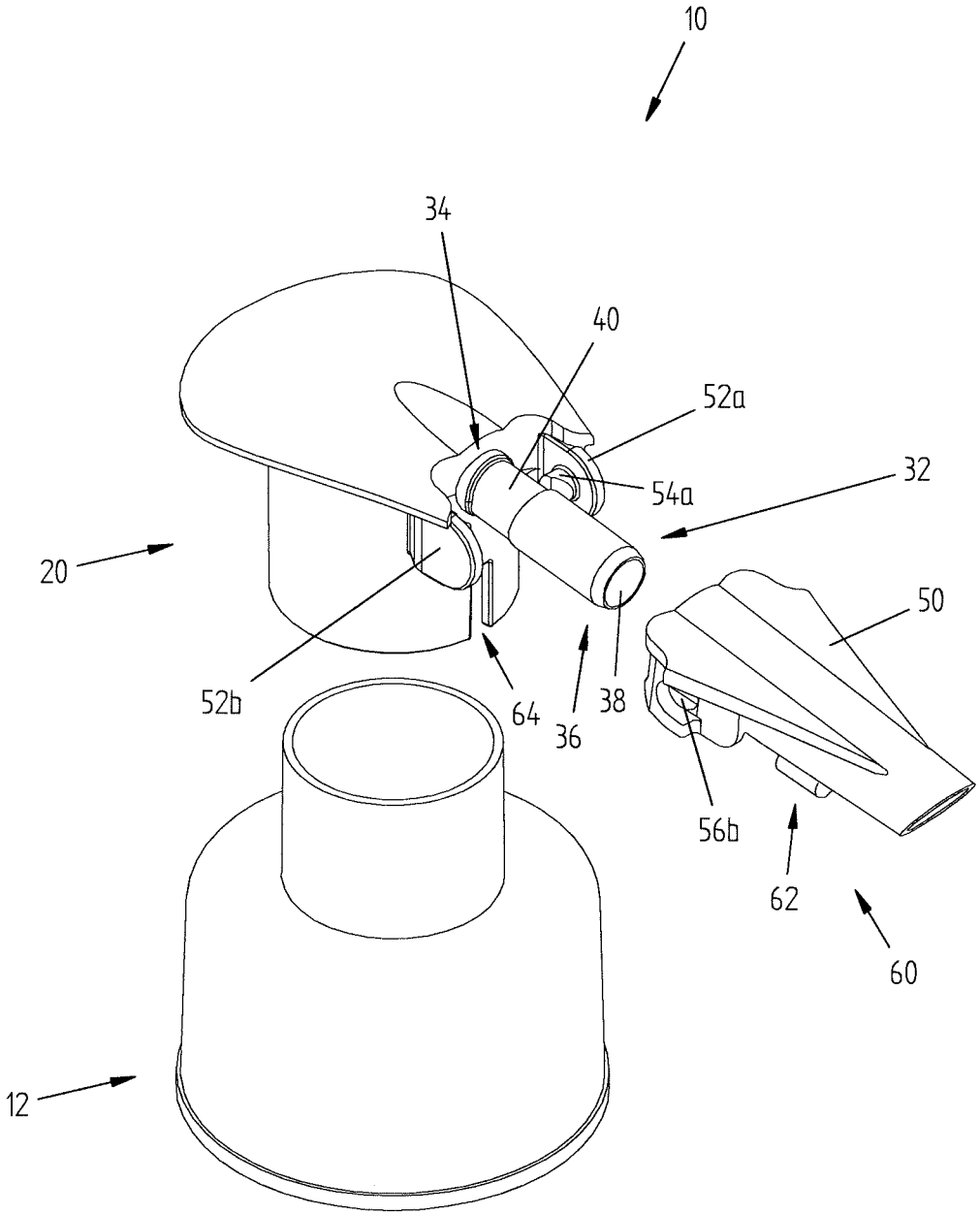
FIG. 3 shows an exploded view of a detail of the device illustrated in FIG. 2.

In said first embodiment, the flexible portion 40 is obtained by partially reducing the thickness of the tubular element 32, as better highlighted in FIG. 3.

Figure 11:
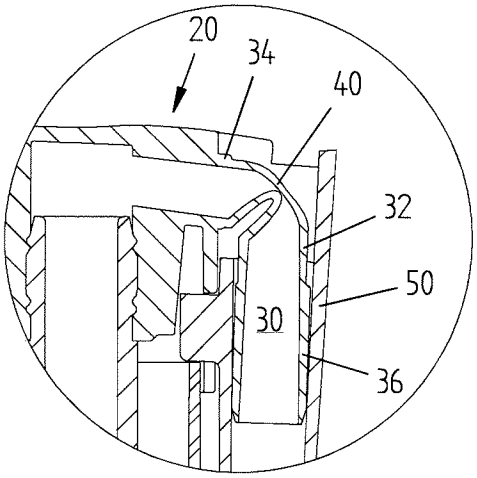
FIG. 11 shows an enlarged detail of FIG. 10.
Figure 10:
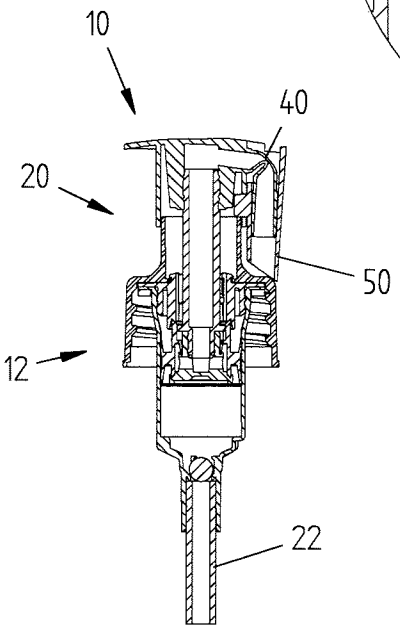
FIG. 10 shows the sectional view of the device illustrated in FIG. 9 according to section line X-X.
Figure 9:
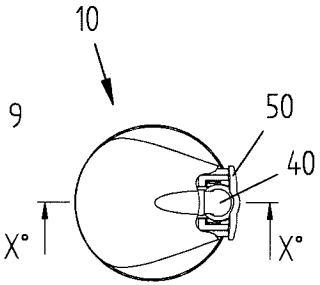
FIG. 9 shows a top plan view of the dispensing device illustrated in FIG. 8.
Figure 8:
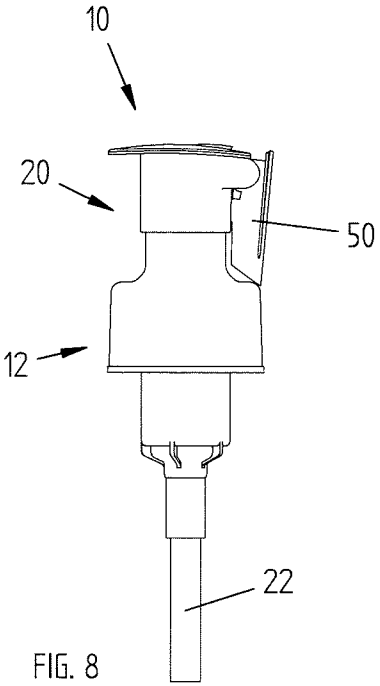
FIG. 8 shows a side view of the dispensing device illustrated in FIG. 7.
Figure 7:
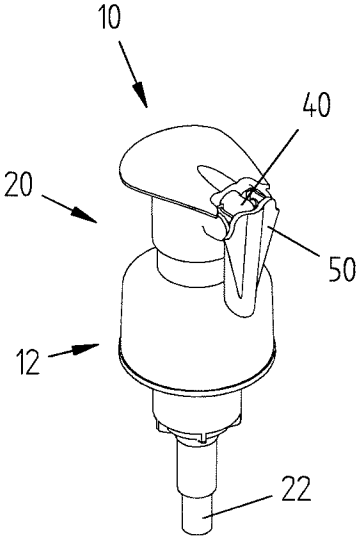
FIG. 7 shows the dispensing device illustrated in FIG. 2 with the dispensing duct in a second position.
Figure 15:
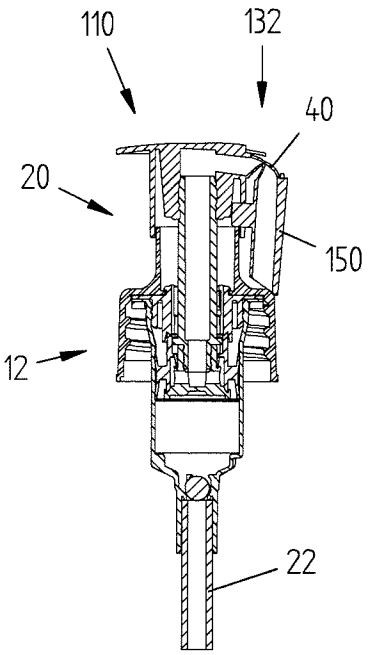
FIG. 15 shows a sectional view of FIG. 14 along a vertical section plane.
Figure 14:
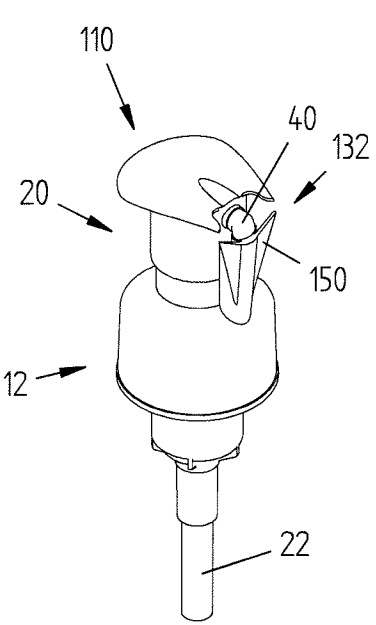
FIG. 14 shows the dispensing device illustrated in FIG. 13 with the dispensing duct in a second position.
Figure 13:
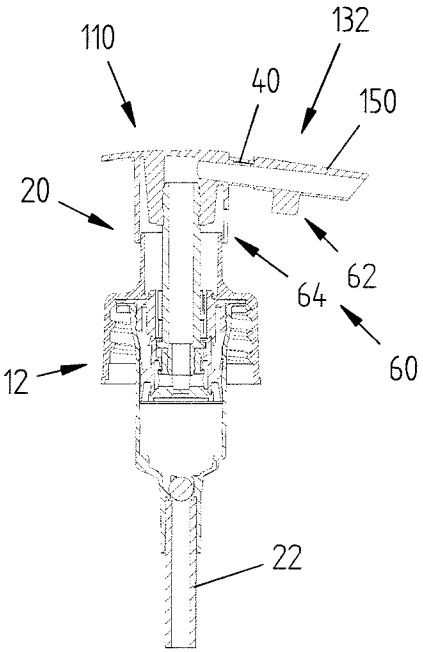
FIG. 13 shows a sectional view of FIG. 12 along a vertical section plane.
Figure 12:
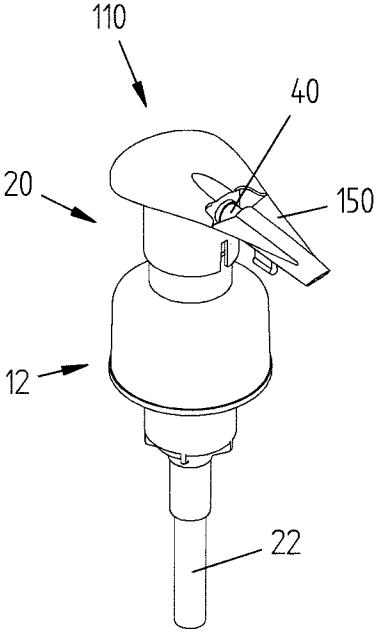
FIG. 12 shows a variant embodiment of FIG. 2 with the dispensing duct in a first operating position.
Figures 16, 17, 18, 19:
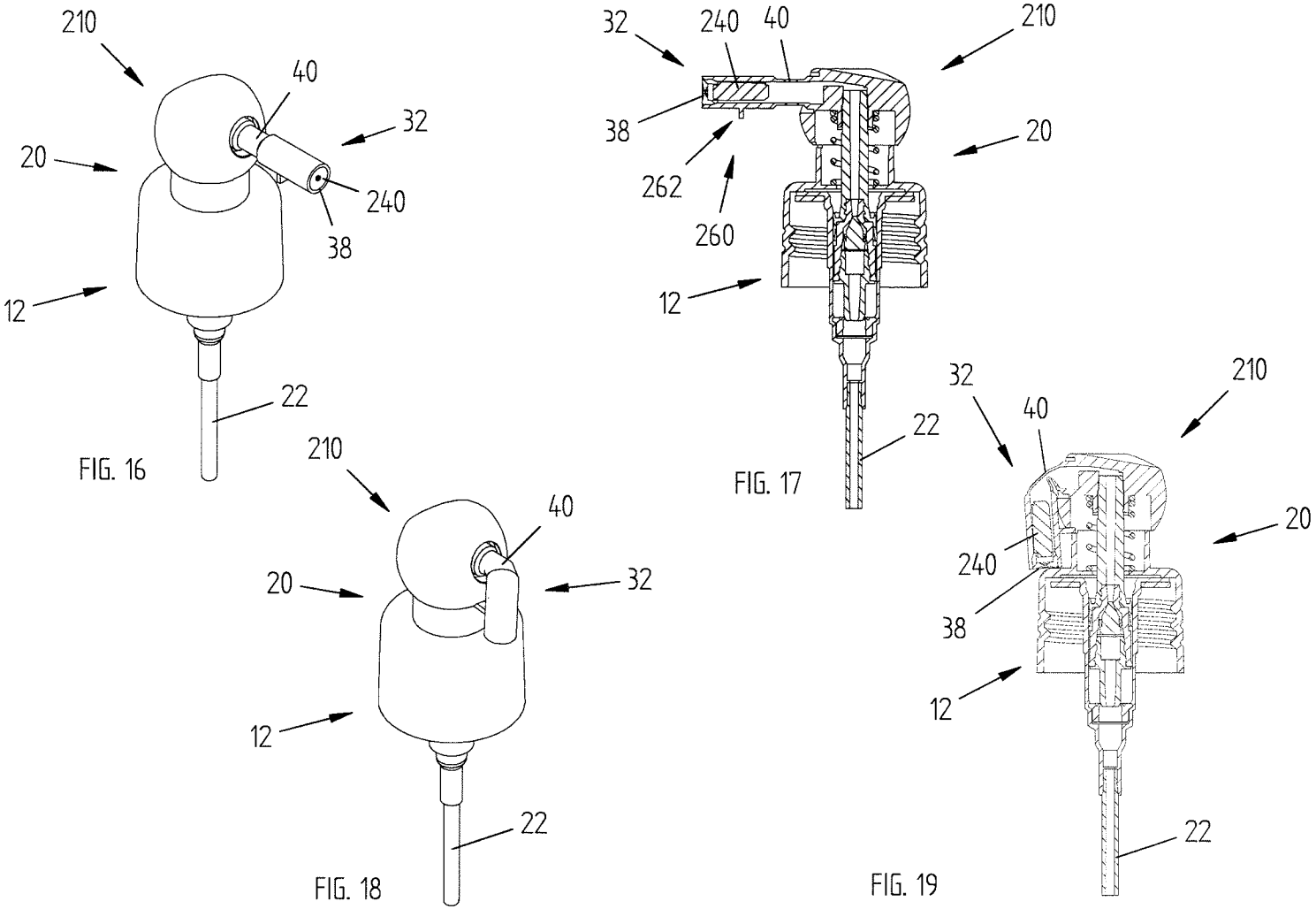
FIG. 16 shows another construction variant of FIG. 2 with the dispensing duct in a first operating position.
FIG. 17 shows a sectional view of FIG. 16 along a vertical section plane.
FIG. 18 shows the dispensing device illustrated in FIG. 16 with the dispensing duct in a second position.
FIG. 19 shows a sectional view of FIG. 18 along a vertical section plane.

The reduction in thickness makes it possible to fold the tubular element 32 and to deform it, which leads to the narrowing of the dispensing duct, as can be seen in the detail shown in FIG. 11.

In variant embodiments, the flexible portion can be obtained in a different manner, as shown even below with reference to Figures from 37 to 53.

Figure 49:
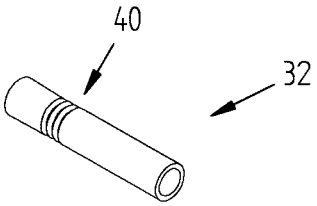
FIG. 49 shows an axonometric view of a construction variant of an element of the device of FIG. 2.

The flexible portion can be preferably obtained by changing the geometric shape of the tubular element, for example by changing its thickness, as explained above, or by shaping the same portion in a specific manner (for example, by shaping it as a bellows, as shown in FIG. 49) or preferably by locally varying the elastic characteristic of the tubular element at the level of the flexible portion, for example through the use of different materials.

Preferably, the second part 36 of the tubular element 32 is enveloped by a spout 50, more preferably made of a rigid plastic material. The spout 50 is preferably hinged to the drawing means 20, substantially at the level of the flexible portion 40 of the tubular element 32.

For this purpose, two tabs 52*a*, 52*b* and respective pins 54*a* associated with the drawing means 20, only one of which 54*a* visible in FIG. 3, are inserted in corresponding holes 56*b* provided in the spout 50. The spout 50 advantageously follows the tubular element 32 when it is arranged in its different positions. The hinged configuration of the spout 50 and the drawing means 20 guides the rotation of the tubular element 32 in its various positions.

According to another of its aspects, the device 10 comprises holding means 60 suited to hold the tubular element 32 in the second position.

In the embodiment illustrated and described with reference to Figures from 1 to 11, the holding means 60 comprise mechanical interference means arranged between the tubular element 32 and the drawing means 20.

The holding means 60 preferably comprise an element 62 projecting from the underside of the spout 50 and suited to be snap-fitted into a slot 64 formed in the drawing means 20.

Advantageously, when the tubular element 32, together with the spout 50, is brought to the second position, the holding means 60 hold the tubular element 32 securely in said position.

At the moment of use of the device 10, the user will need to release the spout 50 and bring the tubular element 32 to the first position, or position of use.

In variant embodiments, the holding means may assume other shapes, some of which are shown in the embodiments described in detail here below.

According to the above description, it is clear that the presence of the tubular element 32, which has no interruptions from its point of connection to the drawing means 20 to its outlet opening 38, makes it possible to avoid leakages of the fluid F, both in the first dispensing position and in the second obstructed position.

Water tightness, furthermore, is guaranteed for a longer time compared to the systems of known type.

Figures from 12 to 15 show a preferred variant embodiment of the dispensing device 110 of the invention, which differs from the embodiment illustrated and described above with reference to Figures from 1 to 11 in that the spout 150 is not hinged to the drawing means 20.

The rotation of the tubular element 132 takes place around its flexible portion 40 while the spout 150 serves the retaining function thanks to the presence of the projecting element 62.

The tubular element 132 and the spout 150 are preferably made in a single piece, preferably in a co-moulded plastic material.

Said second embodiment is simplified compared to the embodiment described above while at the same time offering the same advantages.

Figures from 16 to 19 show another variant embodiment 210 of the dispensing device that is the subject of the invention.

Said embodiment differs from the embodiments previously described first of all in that it does not have any spout encasing the tubular element 32.

Another difference lies in that the tubular element 32 receives in its end portion, in proximity to the outlet opening 38, a diffuser element 240 suited to allow the fluid F to be dispensed in the form of a spray.

A further difference lies in the shape of the projecting element 262 of the holding means 260, which however maintains the same function.

Figures from 20 to 23 show another variant embodiment 310 of the dispensing device that is the subject of the invention.

The device 310 preferably comprises drawing means 320 designed to draw the fluid F from the container C and a dispensing duct 330 designed to dispense the fluid F withdrawn from the container C.

In the preferred embodiment illustrated herein, the drawing means 320 make it possible to dispense the fluid F by overturning the container C in such a way as to position the dispensing duct 330 with its outlet opening 338 facing downwards. The fluid F flows out, preferably due to gravity, through the outlet opening 338, or even due to the pressure exerted on the container C when this is made of a collapsible material.

The dispensing duct 330 is defined by a tubular element 332 having a first part 334 fluidically connected to the drawing means 320 and a second part 336 provided with an outlet opening 338 for the fluid F.

The tubular element 332 comprises a flexible portion 340 suited to allow the second part 336 to be arranged in a first position and in a second position, different from the first position, with respect to the first part 334.

Figure 21:
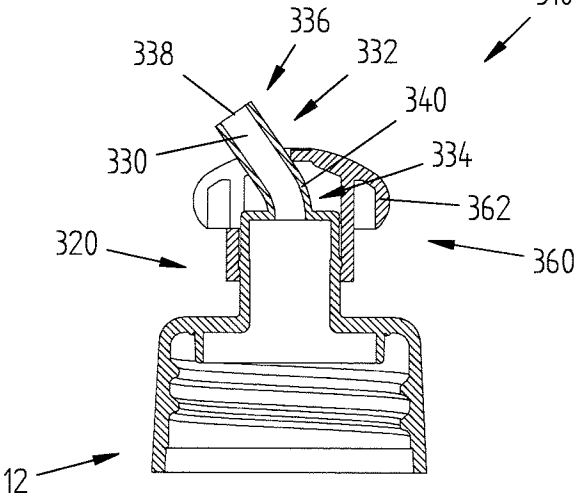
FIG. 21 shows a sectional view of FIG. 20 along a vertical section plane.
Figure 20:
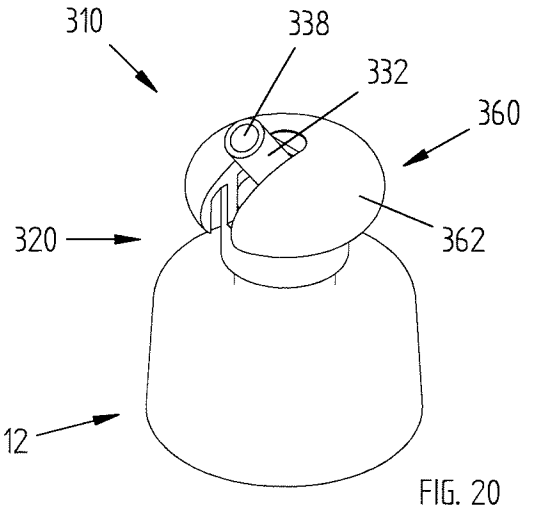
FIG. 20 shows another construction variant of FIG. 2 with the dispensing duct in a first operating position.

FIGS. 20 and 21 show the device 310 with the tubular element 332 arranged in said first position, preferably corresponding to the dispensing position.

Figure 23:
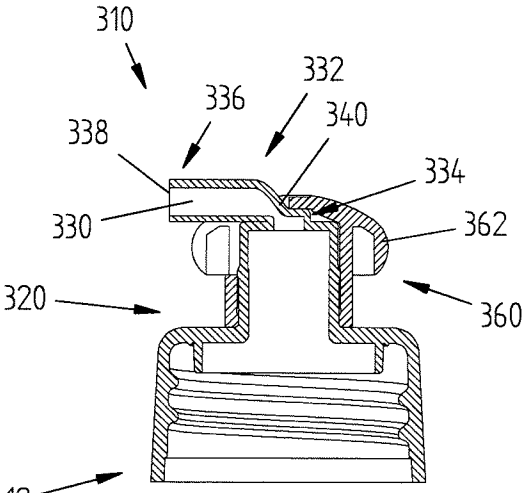
FIG. 23 shows a sectional view of FIG. 22 along a vertical section plane.
Figure 22:
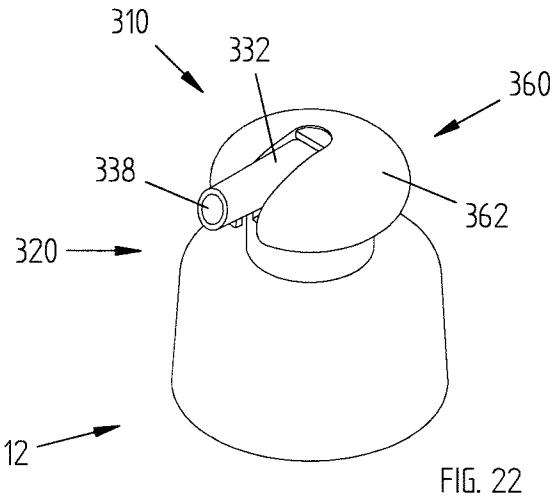
FIG. 22 shows the dispensing device illustrated in FIG. 20 with the dispensing duct in a second position.

FIGS. 22 and 23, instead, show the device 310 with the tubular element 332 arranged in said second position, preferably corresponding to the rest position or packaging position of the device 310.

In the preferred embodiment, as shown in particular in FIG. 23, in the second position the flexible portion 340 partially obstructs the dispensing duct 330.

In said second position, therefore, the outflow of the fluid F from the dispensing duct 330 is at least partially prevented.

In said position, however, the overall dimensions of the tubular element 332 are smaller compared to the first dispensing position, as can be inferred, in particular, by comparing FIGS. 20 and 22.

The device 310 comprises holding means 360 suited to maintain the tubular element 332 in the second position.

The holding means 360 comprise a closing element 362 suited to be arranged in two respective positions: an open position (FIGS. 20 and 21) and a closed position (FIGS. 22 and 23). The closing element 362 preferably slides between said two positions. More specifically, in the closed position the closing element 362 pushes against the tubular element 332, maintaining it in the second position.

Figure 24:
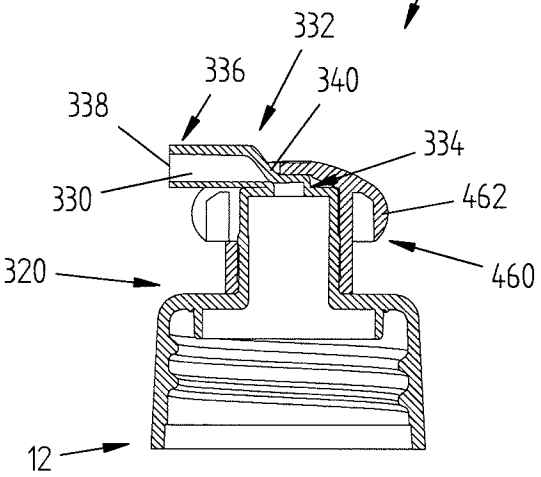
FIG. 24 shows a sectional view of a construction variant of FIG. 23.

FIG. 24 shows a variant embodiment 410 of the dispensing device, which differs from the embodiment shown in Figures from 20 to 23 in that in the closed position the closing element 462 of the holding means 460 is shaped in such a way as to push against the tubular element 332, so that in said second position the dispensing duct 330 is completely obstructed.

Figures from 25 to 28 show another variant embodiment 510 of the dispensing device that is the subject of the invention.

The device 510 preferably comprises drawing means 520 designed to draw the fluid F from a container C (not illustrated) and a dispensing duct 530 designed to dispense the fluid F withdrawn from the container.

The drawing means 520, not described in detail below and visible in FIG. 26, comprise a lever 525 in the shape of a trigger, which is pulled in order to dispense the fluid F from the dispensing duct 530.

The drawing means 520 preferably comprise connection means 512, for example a threaded ring, through which the device 510 can be connected/fixed to the container, preferably screwed to the neck of the container of the fluid F to be dispensed.

The dispensing duct 530 is defined by a tubular element 532 having a first part 534 fluidically connected to the drawing means 520 and a second part 536 provided with an outlet opening 538 for the fluid F.

The tubular element 532 comprises a flexible portion 540 suited to allow the second part 536 to be arranged in a first position and in a second position, different from the first position, with respect to the first part 534.

Figure 26:
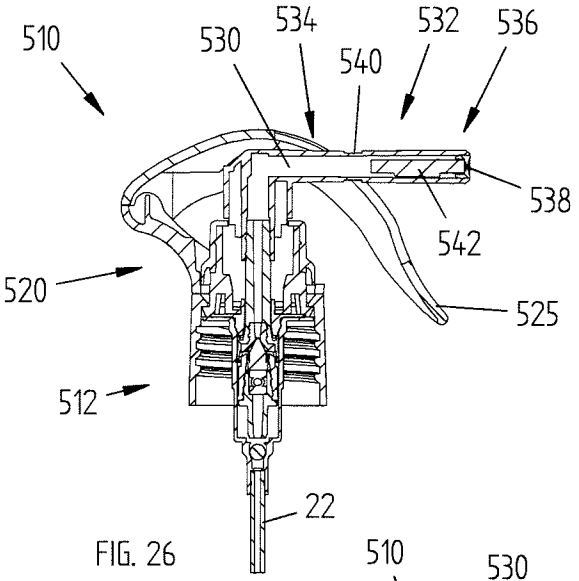
FIG. 26 shows a sectional view of FIG. 25 along a vertical section plane.
Figure 25:
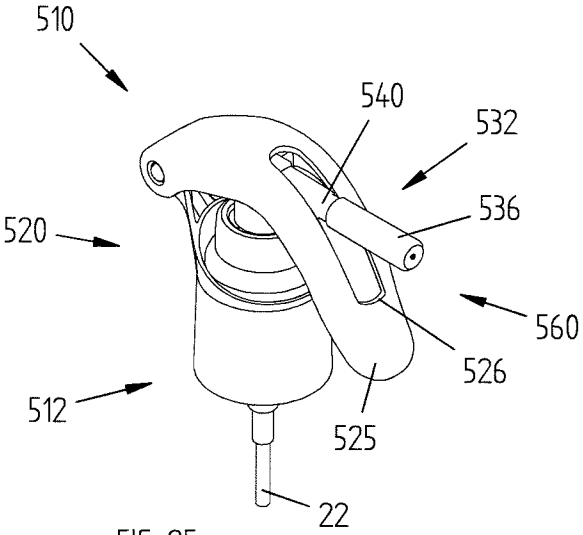
FIG. 25 shows another construction variant of FIG. 2 with the dispensing duct in a first operating position.

FIGS. 25 and 26 show the device 510 with the tubular element 532 arranged in said first position, preferably corresponding to the dispensing position.

Figure 28:
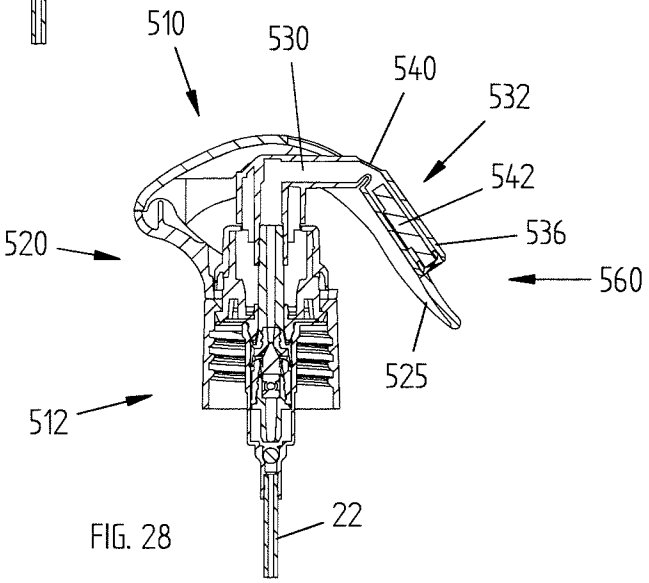
FIG. 28 shows a sectional view of FIG. 27 along a vertical section plane.
Figure 27:
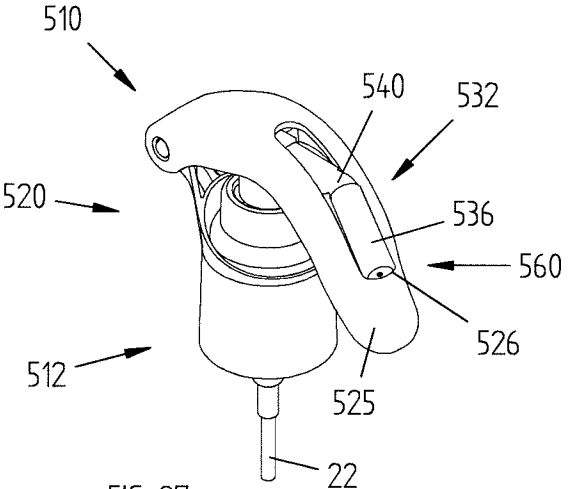
FIG. 27 shows the dispensing device illustrated in FIG. 25 with the dispensing duct in a second position.

FIGS. 27 and 28, instead, show the device 510 with the tubular element 532 arranged in said second position, preferably corresponding to the rest position or packaging position of the device 510.

In the preferred embodiment illustrated herein, in the second position the flexible portion 540 partially obstructs the dispensing duct 530.

In said second position, therefore, the outflow of the fluid F from the dispensing duct 530 is at least partially prevented.

In said position, however, the overall dimensions of the tubular element 532 are smaller compared to the first dispensing position, as can be inferred by comparing FIGS. 25 and 27.

The device 510 comprises holding means 560 suited to maintain the tubular element 532 in the second position.

The holding means 560 are constituted by the mechanical interference of the second part 536 of the tubular element 532 that is pushed into a slot 526 formed in the lever 525.

Furthermore, the tubular element 532 receives in its end portion, in proximity to the outlet opening 538, a diffuser element 542 suited to allow the fluid F to be dispensed in the form of a spray.

Figures from 29 to 32 show another variant embodiment 610 of the dispensing device that is the subject of the invention.

The device 610 preferably comprises drawing means 620 designed to draw the fluid F from the container C and a dispensing duct 630 designed to dispense the fluid F withdrawn from the container C.

In the preferred embodiment illustrated herein, the drawing means 620 make it possible to dispense the fluid F by overturning the container C, in such a way as to position the dispensing duct 630 with its outlet opening 638 facing downwards. The fluid F flows out, preferably due to gravity, through the outlet opening 638, or even due to the pressure exerted on the container C when this is made of a collapsible material.

The dispensing duct 630 is defined by a tubular element 632 having a first part 634 fluidically connected to the drawing means 620 and a second part 636 provided with an outlet opening 638 for the fluid F.

The tubular element 632 comprises a flexible portion 640 suited to allow the second part 636 to be arranged in a first position and in a second position, different from the first position, with respect to the first part 634.

Figure 30:
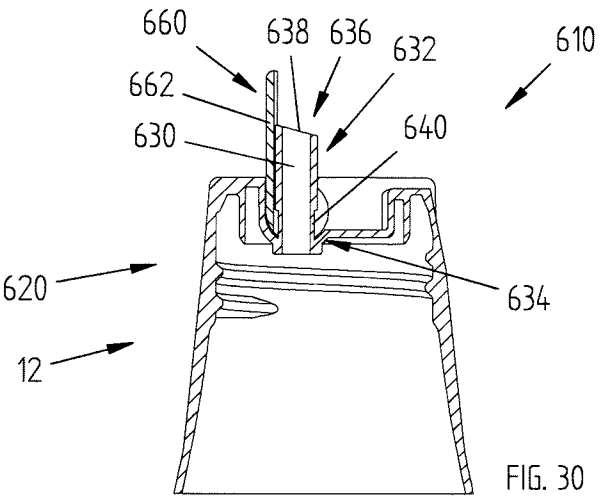
FIG. 30 shows a sectional view of FIG. 29 along a vertical section plane.
Figure 29:
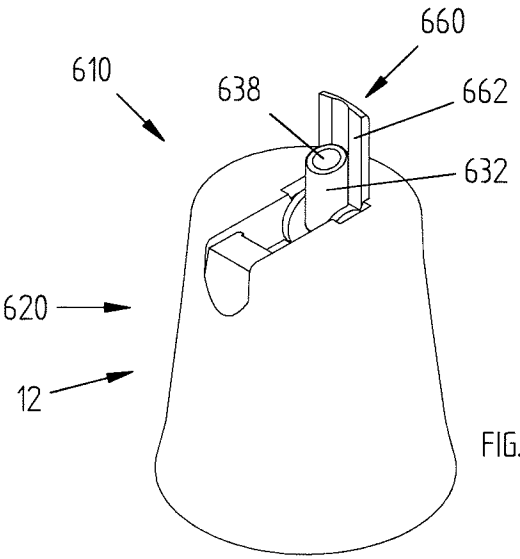
FIG. 29 shows another construction variant of FIG. 2 with the dispensing duct in a first operating position.

FIGS. 29 and 30 show the device 610 with the tubular element 632 arranged in said first position, preferably corresponding to the dispensing position.

Figure 32:
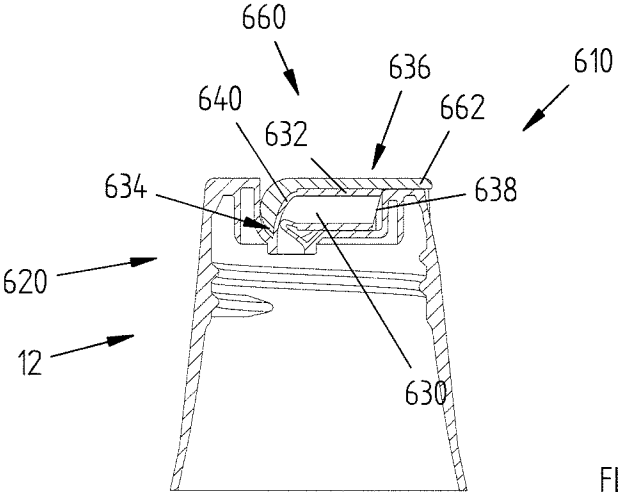
FIG. 32 shows a sectional view of FIG. 31 along a vertical section plane.
Figure 31:
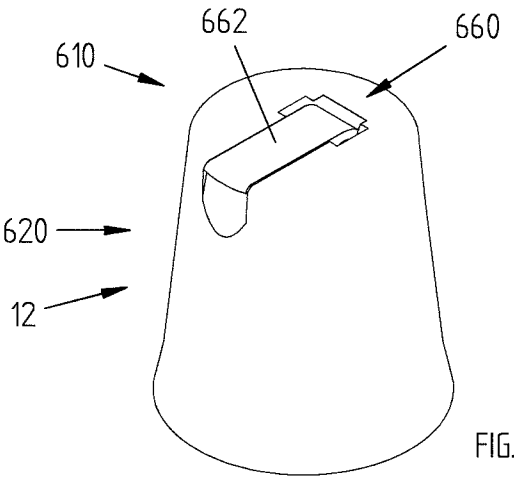
FIG. 31 shows the dispensing device illustrated in FIG. 29 with the dispensing duct in a second position.

FIGS. 31 and 32, instead, show the device 610 with the tubular element 632 arranged in said second position, preferably corresponding to the rest position or packaging position of the device 610, with the dispensing duct 630 completely obstructed.

The device 610 comprises holding means 660 suited to maintain the tubular element 632 in the second position.

The holding means 660 comprise a closing element 662 suited to be arranged in two respective positions: an open position (FIGS. 29 and 30) and a closed position (FIGS. 31 and 32). The closing element 662 preferably slides between said two positions. More specifically, in the closed position the closing element 662 snaps closed, maintaining the tubular element 632 in the second position.

Figures from 33 to 36 show another variant embodiment 710 of the dispensing device that is the subject of the invention.

The device 710 preferably comprises drawing means 720 designed to draw the fluid F from the container C and a dispensing duct 730 designed to dispense the fluid F withdrawn from the container C.

In the preferred embodiment illustrated herein, the drawing means 720 make it possible to dispense the fluid F by overturning the container C, in such a way as to position the dispensing duct 730 with its outlet opening 738 facing downwards. The fluid F flows out, preferably due to gravity, through the outlet opening 738, or even due to the pressure exerted on the container C when this is made of a collapsible material.

The dispensing duct 730 is defined by a tubular element 732 having a first part 734 fluidically connected to the drawing means 720 and a second part 736 provided with an outlet opening 738 for the fluid F.

The tubular element 732 comprises a flexible portion 740 suited to allow the second part 736 to be arranged in a first position and in a second position, different from the first position, with respect to the first part 734.

Figure 34:
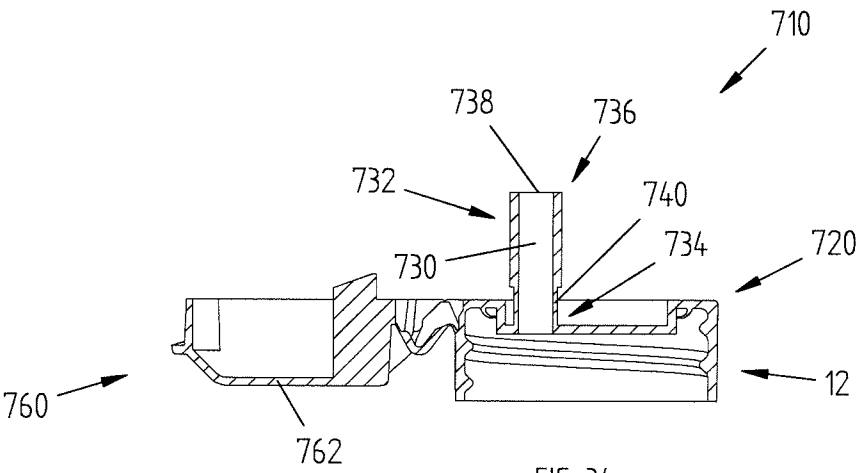
FIG. 34 shows a sectional view of FIG. 33 along a vertical section plane.
Figure 33:
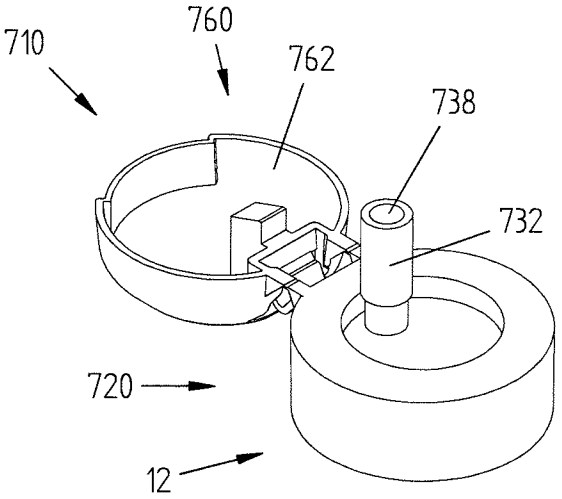
FIG. 33 shows another construction variant of FIG. 2 with the dispensing duct in a first operating position.

FIGS. 33 and 34 show the device 710 with the tubular element 732 arranged in said first position, preferably corresponding to the dispensing position.

Figure 36:
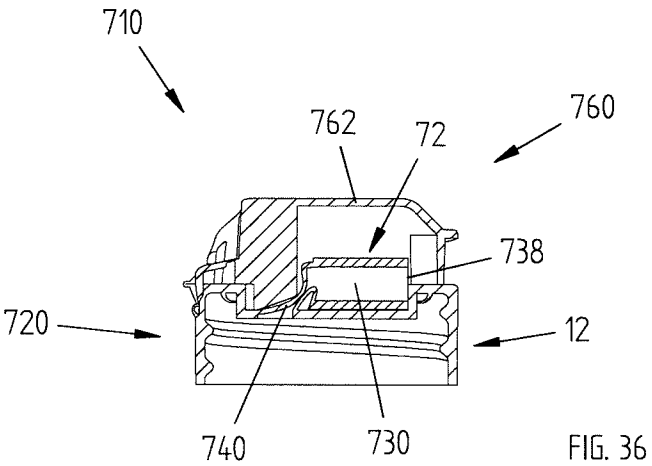
FIG. 36 shows a sectional view of FIG. 35 along a vertical section plane.
Figure 35:
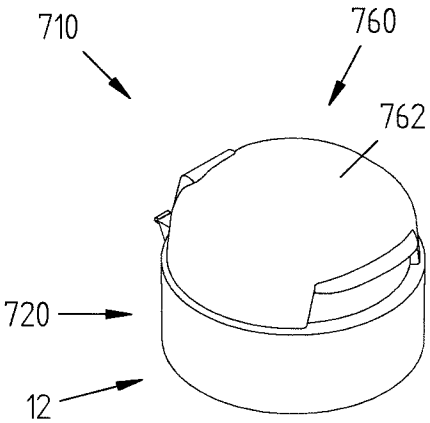
FIG. 35 shows the dispensing device illustrated in FIG. 34 with the dispensing duct in a second position.
Figure 37:
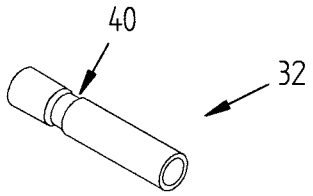
FIG. 37 shows an axonometric view of a construction variant of an element of the device of FIG. 2.

FIGS. 35 and 36, instead, show the device 710 with the tubular element 732 arranged in said second position, preferably corresponding to the rest position or packaging position of the device 710, with the dispensing duct 730 completely obstructed.

The device 710 comprises holding means 760 suited to maintain the tubular element 732 in the second position.

The holding means 760 comprise a closing element 762 suited to be arranged in two respective positions: an open position (FIGS. 33 and 34) and a closed position (FIGS. 35 and 36). Preferably, the closing element 762 can be rotated between said two positions. More specifically, in the closed position the closing element 762 snaps closed, maintaining the tubular element 732 in the second position.

Figures from 37 to 43 show a possible embodiment of the tubular element 32, in which the latter is preferably carried out as a separate element to be connected to the drawing means of the device of the invention, according to the above.

Said embodiment of the tubular element 32 has its flexible portion 40 obtained by changing the thickness of the tubular element 32 itself. In the flexible portion 40, the thickness reduction is substantially uniform.

Figure 38:
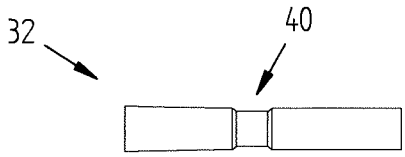
FIG. 38 shows a top plan view of the element illustrated in FIG. 37.
Figure 39:
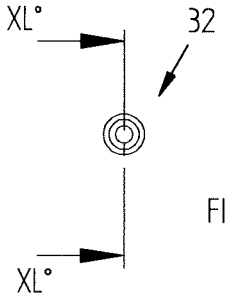
FIG. 39 shows a side view of the element illustrated in FIG. 37.
Figure 40:
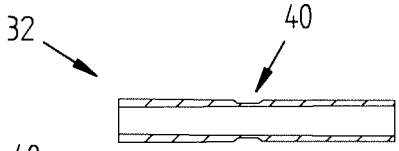
FIG. 40 shows the sectional view of the element illustrated in FIG. 39 according to section line XL-XL.
Figure 41:
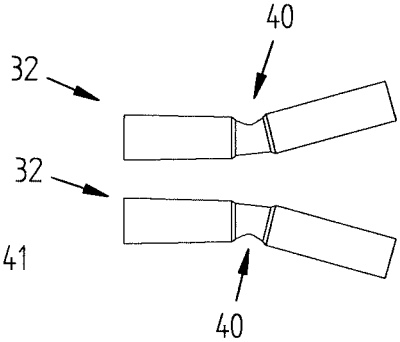
FIG. 41 shows the element illustrated in FIG. 38 in two possible operating positions.

FIG. 41 shows two positions that can be assumed by the tubular element 32, slightly folded and occupying less space compared to the situation illustrated in FIG. 38 (dispensing position).

Figure 42:
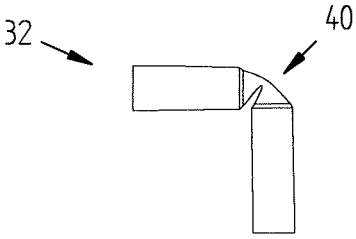
FIG. 42 shows the element illustrated in FIG. 38 in a possible folded operating position.
Figure 43:
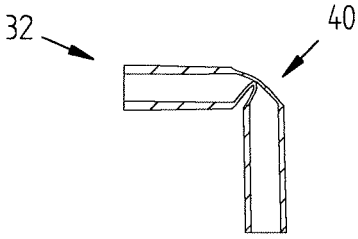
FIG. 43 shows the sectional view of FIG. 42.
Figure 44:
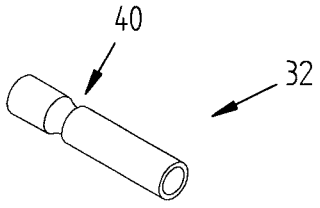
FIG. 44 shows an axonometric view of a construction variant of an element of the device of FIG. 2.

FIGS. 42 and 43 show a totally folded position of the tubular element 32, in which it is completely obstructed.

Figures from 44 to 48 show a variant embodiment of the tubular element 32, which differs from the embodiment of Figures from 37 to 43 due to the different shape of the flexible portion 40. In the flexible portion 40, the section with reduced thickness is curved and therefore the thickness varies accordingly.

Figure 45:
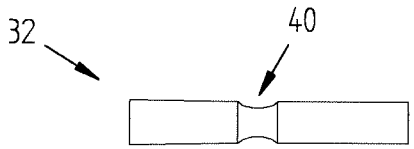
FIG. 45 shows a top plan view of the element illustrated in FIG. 44.
Figure 46:
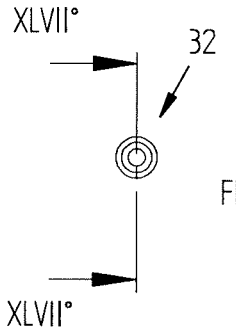
FIG. 46 shows a side view of the element illustrated in FIG. 45.
Figure 47:
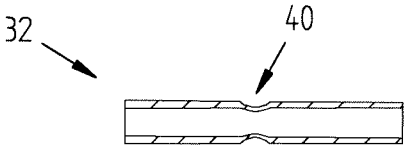
FIG. 47 shows the sectional view of the element illustrated in FIG. 46 according to section line XLVII-XLVII.
Figure 48:
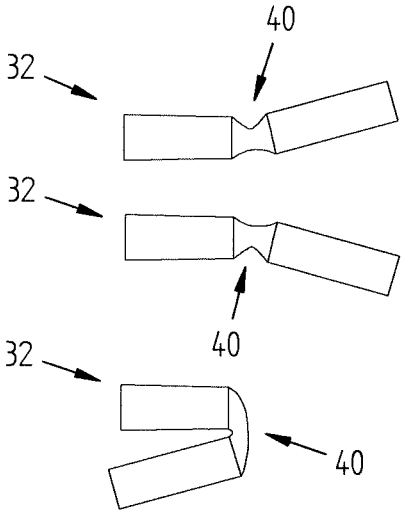
FIG. 48 shows the element illustrated in FIG. 45 in possible operating positions.

FIG. 48 shows two positions that can be assumed by the tubular element 32, slightly folded and occupying less space compared to the situation illustrated in FIG. 45 (dispensing position).

Figure 50:
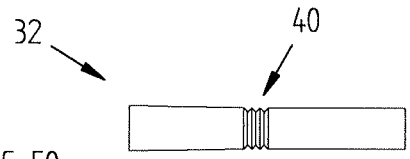
FIG. 50 shows a top plan view of the element illustrated in FIG. 49.
Figure 51:
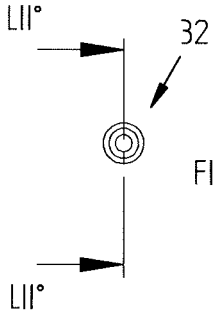
FIG. 51 shows a side view of the element illustrated in FIG. 50.
Figure 52:
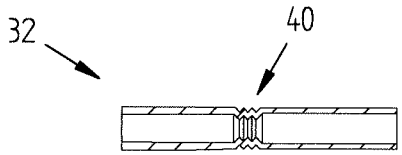
FIG. 52 shows the sectional view of the element illustrated in FIG. 51 according to section line LII-LII.
Figure 53:
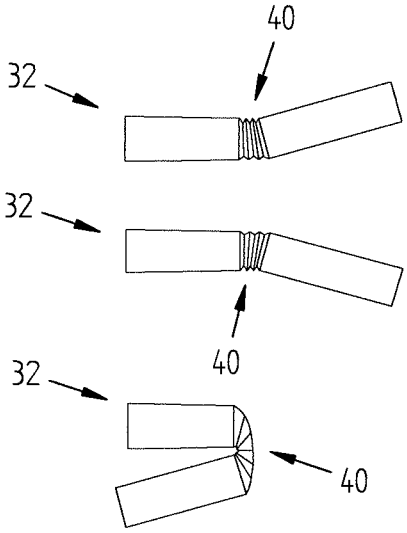
FIG. 53 shows the element illustrated in FIG. 50 in possible operating positions.

Figures from 44 to 53 show a variant embodiment of the tubular element 32, which differs from the embodiment of Figures from 37 to 43 due to the different shape of the flexible portion 40. The flexible portion 40 is shaped as a bellows. FIG. 53 shows some positions that can be assumed by the tubular element 32, slightly folded and occupying less space compared to the situation illustrated in FIG. 50.

It has thus been shown, by means of the previous detailed description of the embodiments of the present invention illustrated in the drawings, that the present invention makes it possible to achieve the set objects and to overcome the drawbacks that are typical of the dispensing devices carried out according to the known art. The present invention, in fact, makes it possible to avoid or at least minimize the risk of leakages of fluid or liquid, independently of the operating position of the dispensing device.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A dispensing device attachable to a container to dispense fluid, the device comprising:

a dispensing cap defining a dispensing duct terminating at an outlet, the dispensing cap movable along a vertical axis to draw fluid through the dispensing duct and out of the outlet;

a tube formed as a single piece without hinges and defining a portion of the dispensing duct, the tube having a proximal end carried on the dispensing cap so as to move along the vertical axis, a distal end positioned proximate the outlet, and a flexible portion disposed between the proximal and distal ends;

wherein the distal end rotates about the flexible portion between a dispensing position in which the tube is unobstructed and a packaging position in which the tube is folded at an acute angle so as to seal and completely obstruct the flexible portion in the dispensing duct thereby preventing fluid passage therethrough.

2. The dispensing device of claim 1 wherein a longitudinal section of the flexible portion consists of an altered geometric shape relative to a shape of longitudinal sections of the proximal and distal ends.

3. The dispensing device of claim 2 wherein the altered geometric shape is an inwardly curved sidewall of reduced thickness.

4. The dispensing device of claim 2 wherein the altered geometric shape is a thinned, straight sidewall of substantially uniform thickness.

5. The dispensing device of claim 2 wherein the altered geometric shape is a bellows.

6. The dispensing device of claim 1 wherein an inner diameter of the tube is constant at all points between the proximal and distal ends when the distal end is in the dispensing position.

7. The dispensing device of claim 6 wherein the distal end is carried on a spout that rotates with the distal end relative to the proximal end.

8. The dispensing device of claim 7 wherein the tube is co-moulded as a single piece with the spout.

9. The dispensing device of claim 7 wherein the spout is hinged to the dispensing cap.

10. A dispensing device attachable to a container to dispense fluid, the device comprising:

a dispensing cap defining a dispensing duct terminating at an outlet, the dispensing cap movable along a vertical axis to draw fluid through the dispensing duct and out of the outlet;

a tube forming a portion of the dispensing duct, the tube having a proximal end carried on the dispensing cap so as to move along the vertical axis, a distal end positioned proximate the outlet, and a flexible portion disposed between the proximal and distal ends;

wherein the distal end: (i) rotates about the flexible portion between a dispensing position in which the tube is unobstructed and a packaging position in which the tube is folded at an acute angle so as to seal and completely obstruct the dispensing duct thereby preventing fluid passage therethrough and (ii) is carried on a spout that rotates with the distal end relative to the proximal end;

wherein an inner diameter of the tube is constant at all points between the proximal and distal ends when the distal end is in the dispensing position; and wherein the dispensing cap includes tabs and pins positioned proximate to the tube and wherein the spout includes holes configured to receive the pins and wherein the tabs, the pins, and the holes are positioned and arranged to retain the spout in the dispensing position or the packaging position.

11. A dispensing device attachable to a container to dispense fluid, the device comprising:

a dispensing cap defining a dispensing duct terminating at an outlet, the dispensing cap movable along a vertical axis to draw fluid through the dispensing duct and out of the outlet;

a tube forming a portion of the dispensing duct, the tube having a proximal end carried on the dispensing cap so as to move along the vertical axis, a distal end positioned proximate the outlet, and a flexible portion disposed between the proximal and distal ends;

a retention formation provided on the tube or on a spout that rotates with the distal end relative to the proximal end;

wherein the distal end: (i) rotates about the flexible portion between a dispensing position in which the tube is unobstructed and a packaging position in which the tube is folded at an acute angle so as to seal and completely obstruct the dispensing duct thereby preventing fluid passage therethrough and (ii) is carried on the spout; and wherein an inner diameter of the tube is constant at all points between the proximal and distal ends when the distal end is in the dispensing position.

12. The dispensing device of claim 11 wherein the retention formation comprises an interference fit between a tab and a slot and wherein the tab and the slot are formed on cooperating interfaces of the dispensing cap and the tube or the spout.

13. The dispensing device of claim 11 wherein the retention formation prevents the movement of the dispensing cap along the vertical axis.

14. A dispensing device attachable to a container to dispense fluid, the device comprising:

a dispensing cap defining a dispensing duct terminating at an outlet, the dispensing cap movable along a vertical axis to draw fluid through the dispensing duct and out of the outlet;

a tube forming a portion of the dispensing duct, the tube having a proximal end carried on the dispensing cap so as to move along the vertical axis, a distal end positioned proximate the outlet, and a flexible portion disposed between the proximal and distal ends;

wherein the distal end rotates about the flexible portion between a dispensing position in which the tube is unobstructed and a packaging position in which the tube is folded at an acute angle so as to seal and completely obstruct the dispensing duct thereby preventing fluid passage therethrough;

wherein an inner diameter of the tube is constant at all points between the proximal and distal ends when the distal end is in the dispensing position; and wherein a diffuser element is positioned in the dispensing duct proximate to the distal end so as to dispense fluid in spray form.

* * * * *